US008113117B2

(12) United States Patent
Nance

(10) Patent No.: US 8,113,117 B2
(45) **Date of Patent: *Feb. 14, 2012**

(54) ENERGETIC MATERIAL INITIATION DEVICE

(75) Inventor: Christopher J. Nance, Middletown, CA (US)

(73) Assignee: Reynolds Systems, Inc., Middletown, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/962,916

(22) Filed: Dec. 8, 2010

(65) Prior Publication Data

US 2011/0072997 A1 Mar. 31, 2011

Related U.S. Application Data

(60) Continuation of application No. 12/497,171, filed on Jul. 2, 2009, now Pat. No. 7,866,264, which is a division of application No. 11/541,998, filed on Sep. 29, 2006, now Pat. No. 7,571,679.

(51) Int. Cl.
*F42B 3/10* (2006.01)

(52) U.S. Cl. ..... 102/202.9; 102/202.5; 102/202.8; 102/202.14

(58) Field of Classification Search ..... 102/202.5, 102/202.7, 202.8, 202.9, 202.14, 200
See application file for complete search history.

(56) References Cited

U.S. PATENT DOCUMENTS

| | | | | |
|---|---|---|---|---|
| 4,103,619 | A | 8/1978 | Fletcher et al. | |
| 4,261,263 | A | 4/1981 | Coultas et al. | |
| 4,600,960 | A | 7/1986 | Clark | |
| 5,230,287 | A * | 7/1993 | Arrell et al. | 102/202.5 |
| 5,431,101 | A * | 7/1995 | Arrell et al. | 102/202.5 |
| 5,831,203 | A | 11/1998 | Ewick | |
| 5,920,029 | A * | 7/1999 | Teaford | 102/202.2 |
| 5,969,286 | A * | 10/1999 | Ward et al. | 102/202.7 |
| 6,158,347 | A | 12/2000 | Neyer et al. | |
| 6,178,888 | B1 | 1/2001 | Neyer et al. | |
| 6,289,813 | B1 | 9/2001 | Duguet et al. | |
| 6,305,286 | B1 | 10/2001 | Fogle, Jr. et al. | |
| 6,324,979 | B1 | 12/2001 | Troianello | |
| 6,357,355 | B1 | 3/2002 | Fogle, Jr. | |
| 6,408,758 | B1 | 6/2002 | Duguet | |
| 6,640,718 | B2 | 11/2003 | Duguet et al. | |
| 6,851,370 | B2 | 2/2005 | Reynolds et al. | |
| 6,923,122 | B2 | 8/2005 | Hennings et al. | |
| 7,430,963 | B2 | 10/2008 | Hennings et al. | |
| 7,543,532 | B2 | 6/2009 | Nance | |
| 7,552,680 | B2 | 6/2009 | Nance et al. | |
| 2002/0002924 | A1 | 1/2002 | Duguet et al. | |
| 2002/0079030 | A1 | 6/2002 | Chan et al. | |
| 2005/0155509 | A1 | 7/2005 | Matsuda et al. | |
| 2005/0188875 | A1 | 9/2005 | Matsuda et al. | |
| 2005/0235858 | A1 | 10/2005 | Reynolds et al. | |
| 2007/0029572 | A1 * | 2/2007 | Han et al. | 257/99 |
| 2007/0095236 | A1 | 5/2007 | Maruyama et al. | |
| 2007/0119325 | A1 | 5/2007 | Hennings et al. | |
| 2007/0163457 | A1 | 7/2007 | Matsumura et al. | |

* cited by examiner

*Primary Examiner* — James Bergin
*Assistant Examiner* — Daniel Troy
(74) *Attorney, Agent, or Firm* — Harness, Dickey & Pierce, P.L.C.

(57) ABSTRACT

An initiator that includes a header body, an insulating spacer, an initiator, a plurality of terminals and a plurality of contacts. The insulating spacer is coupled to the header body. The initiator forms at least a portion of an exploding foil initiator and includes a plurality of electric interfaces. The initiator is secured to a side of the insulating spacer opposite the header body. The terminals extend through the header body. The contacts electrically couple the electric interfaces to the terminals.

19 Claims, 4 Drawing Sheets

ENERGETIC MATERIAL INITIATION DEVICE

This application is a continuation of U.S. application Ser. No. 12/497,171 filed Jul. 2, 2009 (now U.S. Pat. No. 7,866, 264), which is a division of U.S. patent application Ser. No. 11/541,998 filed Sep. 29, 2006 (now U.S. Pat. No. 7,571, 679). The disclosure of the above-referenced applications are hereby incorporated by reference as if fully set forth in detail herein.

INTRODUCTION

The present invention generally relates to devices for initiating an event involving combustion, deflagration and/or detonation in an energetic material.

Modern initiator assemblies, such as detonators, commonly employ materials including ceramics and stainless steels in their construction. These materials are typically selected to provide the initiator assembly with a degree of robustness that permits the initiator assembly to withstand extreme changes in temperature and humidity, as well as to resist oxidization. While modern initiator assembly configurations are generally satisfactory for their intended purposes, they are nonetheless susceptible to improvement.

For example, many of these initiator assemblies, particularly those that employ exploding foil initiators, are relatively difficult and labor-intensive to fabricate. Consequently, they are relatively expensive and are not employed in many applications due to considerations for cost. One proposed solution is a plastic encapsulated energetic material initiation device of the type that is disclosed in U.S. Patent Application Publication No. 2005/0235858A1, the disclosure of which is hereby incorporated by reference as if fully set forth in detail herein. This energetic material initiation device, however, may not be suited for some applications, such as in devices that experience relatively high shock loads and/or require a very strong and durable hermetic seal.

SUMMARY

In one form, the present teachings provide an initiator assembly having a header body, a plurality of seal members, an insulating spacer, a frame member, an initiator, a plurality of terminals and a plurality of terminal-to-initiator contacts. The header body has a plurality of first terminal apertures formed there through. Each seal member is received in an associated one of the first terminal apertures. The insulating spacer is received over the header body. The frame member overlies the insulating spacer and defines an interior aperture. The initiator is received in the interior aperture and abutted against the insulating spacer on a side opposite the header body. The initiator includes a plurality of initiator contacts and is configured to initiate an energetic material such that the energetic material is at least partly consumed in an event involving one or more of combustion, deflagration and detonation. Each of the terminals is received through the insulating spacer and an associated one of the seals. Each of the terminals is received in the frame member at a location that is outward of the interior aperture. Each terminal-to-initiator contact is electrically coupled to an associated one of the terminals and an associated one of the initiator contacts.

In another form, the present teachings provide an initiator assembly that includes a header body, a plurality of terminals, a plurality of seal members, an insulating spacer, a frame member, an initiator chip and a plurality of contacts. The header body has a plurality of first terminal apertures formed there through. The terminals extend through the first terminal apertures in the header body. Each seal member is received in an associated one of the first terminal apertures and is sealingly engaged to the header body and an associated one of the terminals. The insulating spacer is coupled to the header body. The frame member is received over the insulating spacer. The frame member includes a frame body, which defines a frame aperture, and a plurality of frame contacts that are coupled to the frame body. Each of the frame contacts is electrically coupled to a corresponding one of the terminals. The initiator chip forms at least a portion of an exploding foil initiator and includes a plurality of electric interfaces. The initiator chip is received in the frame aperture and secured to a side of the insulating spacer opposite the header body. The contacts electrically couple the electric interfaces to the frame contacts.

In yet another form, the present disclosure provides an initiator assembly that includes a header body, a plurality of seal members, an insulating spacer, a structure and a plurality of terminals. The header body has a plurality of first terminal apertures formed there through. Each seal member is received in an associated one of the first terminal apertures. The insulating spacer is received over the header body. The structure has an insulating body, which overlies the insulating spacer, a plurality of initiator contacts and a bridge that is configured to form a plasma to initiate an event involving one or more of combustion, deflagration and detonation. The initiator contacts and the bridge are coupled to the insulating body. Each of the terminals is received through the insulating spacer and an associated one of the seals and is electrically coupled to an associated one of the initiator contacts.

In a further form, the present disclosure provides an initiator assembly that includes a header body, a plurality of seal members, an insulating spacer, a frame member, an initiator and a plurality of terminals. The header body has a plurality of first terminal apertures formed there through into which an associated one of the seal members is received. The insulating spacer is received over the header body. The frame member overlies the insulating spacer and defines an interior aperture. The initiator is received in the interior aperture and is abutted against the insulating spacer on a side opposite the header body. The initiator includes a plurality of initiator contacts and is configured to initiate an energetic material such that the energetic material is at least partly consumed in an event involving one or more of combustion, deflagration and detonation. Each of the terminals is received through the insulating spacer and an associated one of the seals. Each of the terminals is disposed outwardly of the interior aperture and electrically coupled to an associated one of the initiator contacts.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

DETAILED DESCRIPTION OF THE VARIOUS EMBODIMENTS

Figure 1:
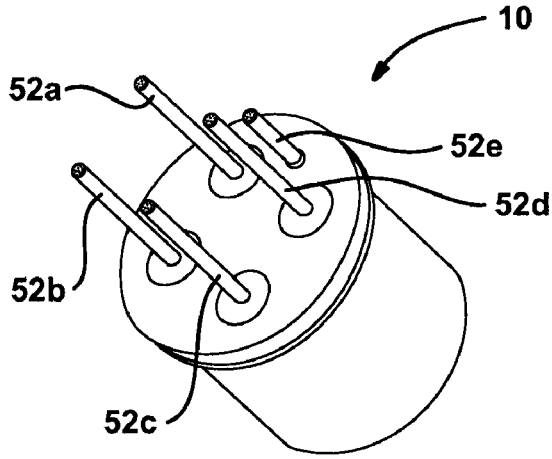
FIG. 1 is a rear perspective view of an energetic material initiation device constructed in accordance with the teachings of the present disclosure.
Figure 2:
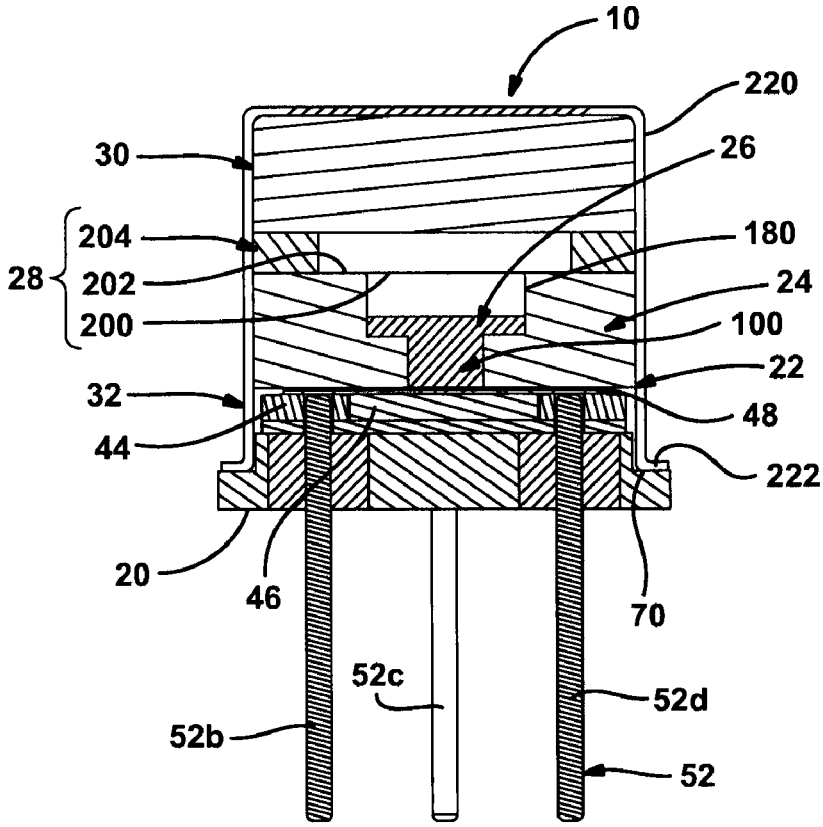
FIG. 2 is a longitudinal section view of the energetic material initiation device of FIG. 1.

With reference to FIGS. 1 and 2 of the drawings, an initiator constructed in accordance with the teachings of the present invention is generally indicated by reference numeral 10. While the initiator 10 is illustrated as being a detonator-type initiator, the initiator 10 may be any type of initiator and may be configured to initiate a combustion event, a deflagration event and/or a detonation event. The initiator 10 can include a header assembly 20, an insulator barrel 22, an input sleeve 24, an input charge 26, a barrier 28, an output charge 30 and a cover 32.

Figure 3:
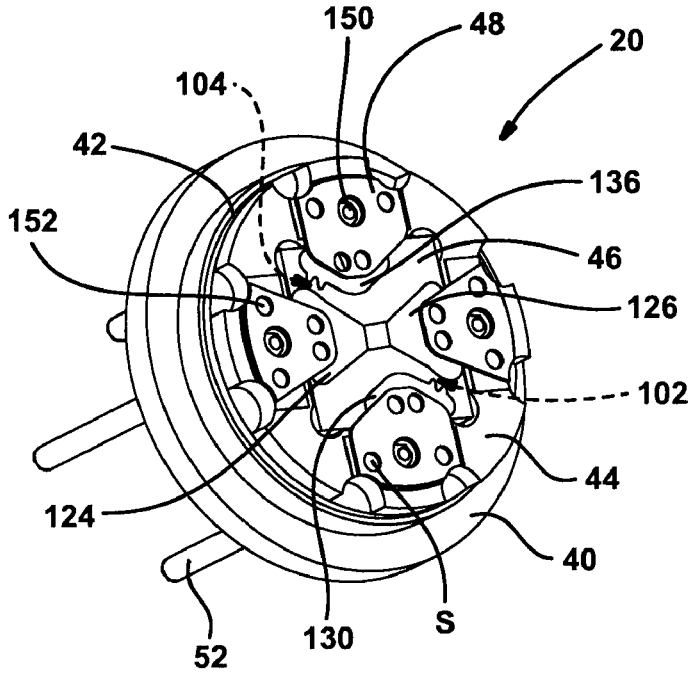
FIG. 3 is a front perspective view of a portion of the energetic material initiation device of FIG. 1, illustrating the header assembly in more detail.
Figure 4:
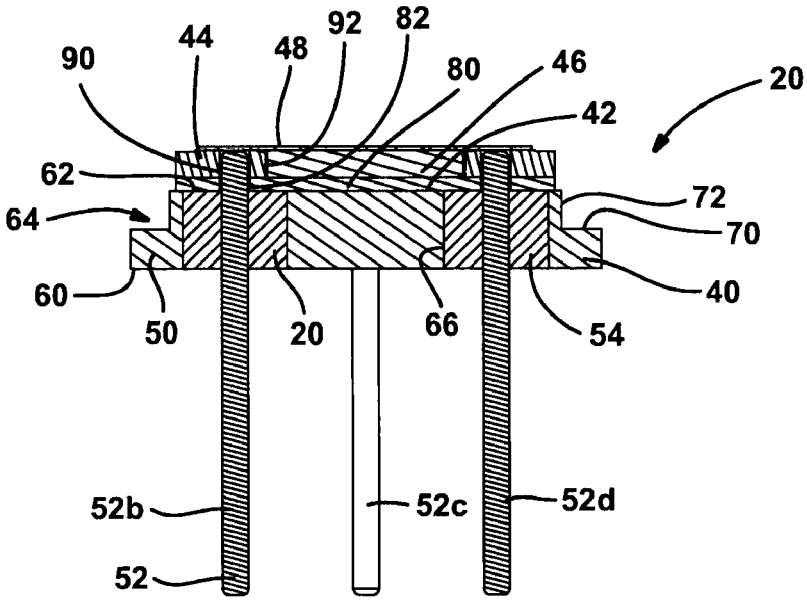
FIG. 4 is a longitudinal section view of the header assembly.
Figure 5:
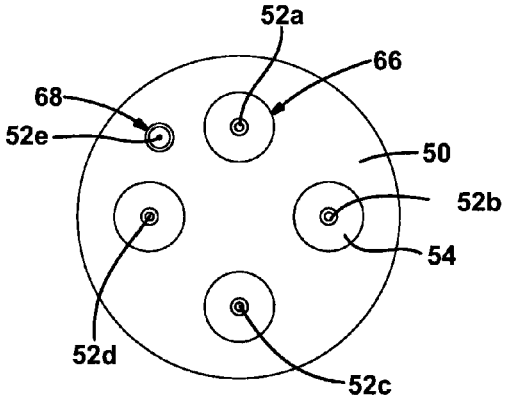
FIG. 5 is a bottom view of the header assembly.

With reference to FIGS. 3 and 4, the header assembly 20 can include a header 40, an insulating spacer 42, a frame member 44, an initiator chip 46 and a plurality of contacts 48. The header 40 can include a header body 50, a plurality of terminals 52, and a plurality of seal members 54.

The header body 50 can be formed of an appropriate material, such as KOVAR®, and can be shaped in a desired manner. The header body 50 can define first and second end faces 60 and 62, respectively, a shoulder 64, a plurality of first terminal apertures 66 and a second terminal aperture 68. The shoulder 64 can include an abutting face 70, which can be generally parallel to the first and second end faces 60 and 62, and a shoulder wall 72 that is generally perpendicular to the abutting face 70. The first terminal apertures 66 can be formed through the header body 50 generally perpendicular to the first and second end faces 60 and 62. The second terminal aperture 68 can be a blind hole that is formed in the header body 50 through the first end face 60.

With additional reference to FIG. 1, a first quantity of the terminals 52 (e.g., terminals 52*a* through 52*d*) can be received in respective ones of the first terminal apertures 66 and can extend outwardly from the first and second end faces 60 and 62. A remaining one of the terminals 52*e* can be received in the second terminal aperture 68 and can be fixedly electrically coupled to the header body 50. In the particular example provided, the terminal 52*e* is soldered to the header body 50 and can serves as a means for electrically coupling the header body 50 to an electric ground (not shown). It will be appreciated that the terminals 52 can be arranged in a non-symmetrical manner to thereby key the header 40 in a particular orientation relative to the device (not shown) to which the initiator 10 is to be coupled. It will also be appreciated that a keying feature, such as a tab (not shown) or a recess (not shown), can be incorporated into a portion of the header 40 (e.g., the header body 50) to key the header 40 in a particular orientation.

Returning to FIGS. 3 and 4, the seal members 54 can be formed of a suitable material, such as glass conforming to 2304 Natural or another dielectric material, and can be received into an associated one of the first terminal apertures 66. The seal members 54 sealingly engage the header body 50 as well as an associated one of the terminals 52. The seal members 54 can form a relatively strong seal, such as a seal that will leak at a rate less than about $1\times10^{-5}$ or $1\times10^{-6}$ units when one side of the header body 50 is exposed to helium gas at a gauge pressure of about 1 atmosphere while the other side of the header body 50 is exposed to atmospheric pressure.

The insulating spacer 42 can be formed of a suitable dielectric material, such as polycarbonate, synthetic resin bonded paper (SRBP) or epoxy resin bonded glass fabric (ERBGF), and can define a body 80 having a plurality of clearance apertures 82 that are sized to receive the terminals 52*a* through 52*d* (FIG. 1) there through. The body 80 can be received onto the second end face 62 and within a volume that is defined by the shoulder wall 72.

The frame member 44 can include a body 44*a* and a plurality of electrical conductors 44*b*. The body 44*a* can be formed of an appropriate dielectric material, such as synthetic resin bonded paper (SRBP) or epoxy resin bonded glass fabric (ERBGF). The conductors 44*b* can be arranged about the body 44*a* in a predetermined manner and can comprise one or more conductive layers of material, such as gold, silver, copper, nickel and alloys thereof. The conductors 44*b* can be formed onto the body 44*a* in any desired manner, such as through metallization of the entire surface of the body 44*a* and acid-etch removal of portions of the metallization that are not desired. The frame member 44 can be sized and shaped to closely conform to the size and shape of the insulating spacer 42 and can include a plurality of terminal apertures 90 and an interior aperture 92 that is sized to receive the initiator chip 46. The terminal apertures 90 can be sized to receive a corresponding one of the terminals 52 (e.g., terminals 52*a* through 52*d* in FIG. 1) therein.

In the particular example provided, the initiator chip 46 is constructed in a manner that is disclosed in co-pending U.S. patent application Ser. Nos. 11/431,111 and 11/430,944 entitled "Full Function Initiator With Integrated Planar Switch" the disclosures of which are hereby incorporated by reference as if fully set forth in detail herein. Briefly, the initiator chip 46 includes at least a portion of an exploding foil initiator 100 (FIG. 1), a first switch 102 and a second switch 104.

Figure 6A:
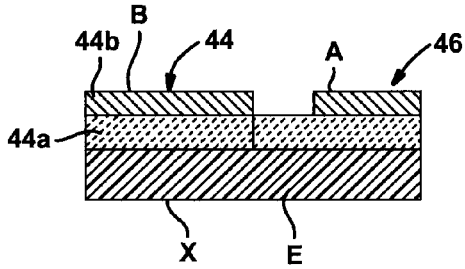
FIG. 6A is a section view taken along the line 6A-6A of FIG. 6.
Figure 6:
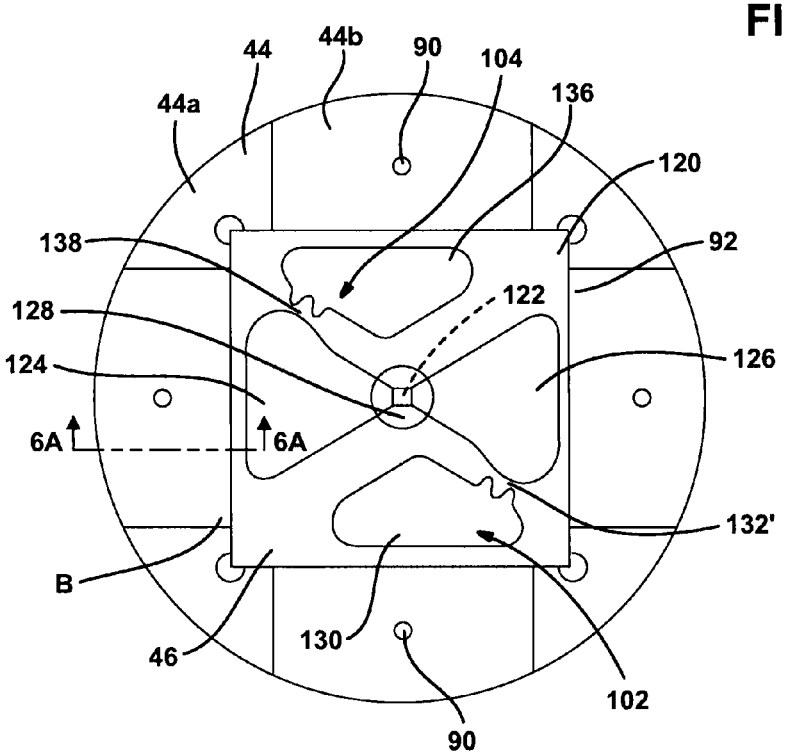
FIG. 6 is a top plan view of a portion of the header assembly illustrating the frame member and the initiator chip in more detail.

With reference to FIG. 6, the portion of the exploding foil initiator 100 (FIG. 1) can conventionally include a substrate 120, a bridge 122, first and second bridge contacts 124 and 126, respectively, and a flyer 128. The substrate 120 can be formed of an appropriate structural material, such as a ceramic. The bridge 122 and the first and second bridge contacts 124 and 126 can be coupled to the substrate 120 and can be formed of an appropriate conductive material, such as gold, silver, copper, nickel and alloys thereof. The bridge 122 and the first and second bridge contacts 124 and 126 can be formed in one or more layers that can be deposited onto the substrate 120 in an appropriate manner, such as by vapor deposition. The first switch 102 can include a first switch pad 130 that can be coupled to the substrate 120 and offset from the first bridge contact 126 by a first gap 132. The second switch 104 can include a second switch pad 136 that can be coupled to the substrate and offset from the second bridge contact 124 by a second gap 138. While the initiator chip 46 has been illustrated and described as including an exploding foil initiator and one or more switches that provide the initiator chip 46 with integrated switching capabilities, those of ordinary skill in the art will appreciate that any appropriate initiator chip (e.g., an initiator chip without integrated switching capabilities) may be employed. The flyer 128 can be formed of an appropriate material, such as polyamide.

With additional reference to FIGS. 3 and 4, the initiator chip 46 can be received in the interior aperture 92 that is formed by the frame member 44. In the particular example provided, an adhesive, such as SCOTCH-WELD™ EC-2216 Grey epoxy marketed by Minnesota Mining and Manufacturing Company of St. Paul, Minn., is employed to bond the frame member 44 and the initiator chip 46 to the insulating spacer 42 as well as to bond the insulating spacer 42 to the header body 50. It will be appreciated that the surface A (FIG. 6) of the initiator chip 46 and the surface B (FIG. 6) of the frame 44 can be abutted against a flat surface so that the surfaces A and B will be substantially parallel and co-planar. With reference to FIG. 6A, the epoxy E can be applied to the surfaces of the initiator chip 46 and the frame member 44 opposite the surfaces A and B, respectively. The epoxy E can be employed to secure the frame member 44 and the initiator chip 46 to one another, as well as to provide a bottom surface X of the assembly that is generally parallel to the surfaces A and B. In this way, the top and bottom surfaces of the assembly (i.e., the frame member 44, the initiator chip 46 and the epoxy E) can be flat and parallel within a desired tolerance, such as 0.001 inch. The terminal apertures 90 can be formed via a suitable process, such as drilling.

Figure 7:
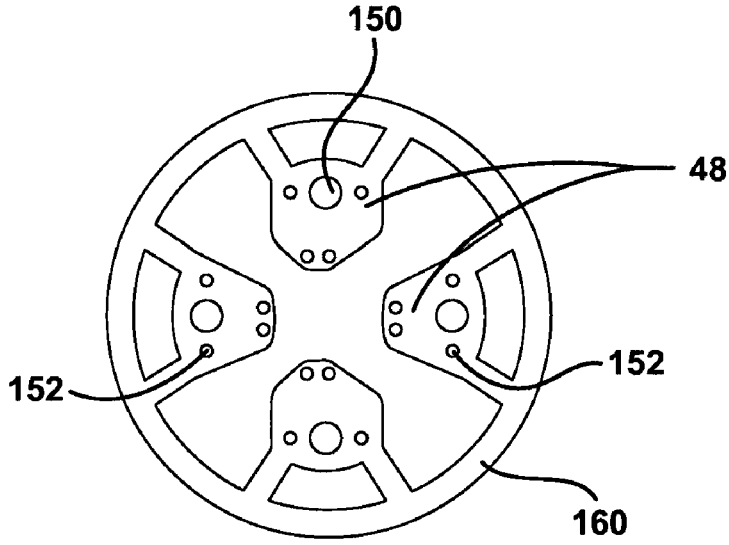
FIG. 7 is a top plan view of a portion of the header assembly illustrating the contacts as coupled to a lead frame.

With reference to FIGS. 3 and 7, the contacts 48 can be formed of a suitable electrically conductive material, such as KOVAR® having a thickness of about 0.003 inch, and can include a terminal aperture 150 that can receive an associated one of the terminals 52 (e.g., the terminals 52*a* through 52*d* in FIG. 1) and a plurality of solder apertures 152. The contacts 46 can be shaped to engage an associated electric interface (e.g., the first bridge contact 124, the second bridge contact 126, the first switch pad 130 and the second switch pad 136). In the particular example provided, the contacts 48 are soldered to an associated one of the terminals 52 and an associated one of the electric interfaces with an appropriate solder S (FIG. 3), such as a F540SN62-86D4 solder paste marketed by Heraeus Inc., Circuit Materials Division of Scottsville, Ariz. The solder apertures 152 permit solder to flow through the contacts 48 in predetermined areas, such as locations in-line with the associated electric interfaces and in-line with the conductors 44*b* (FIG. 6) of the frame member 44. Accordingly, it is possible to visually-inspect the solder joints associated with each contact 48 through the solder apertures 152 and the terminal aperture 150.

We have found it to be desirable to form the contacts 48 such that they are connected to one another and form a lead frame 160. The terminals 52 can be received in a high-tolerance fixture (not shown), insulating spacer 42, and the frame 44 can be placed onto the terminals 52 using the terminals 52 as guide pins. The lead frame 160 can be oriented to the header body 50 and thereafter the lead frame 160 and the header body 50 can be clamped together via an assembly fixture (not shown). The header body 50 and the lead frame 160 can be processed through a reflow oven to solder the contacts 48 to the terminals 52, the conductors 44*b* (FIG. 6) and the associated electric interfaces in a single soldering operation. The header assembly 20 can thereafter be separated from the lead frame 160 by shearing the contacts 48 from the lead frame 160. The insulating spacer 42 can prevent the contacts 48 from shorting to the header body 50. Moreover, the contacts 48 can be sheared from the lead frame in a direction that drives the sharp edges of the contacts 48 into the frame member 44. It will be appreciated that as a force is applied to assembly prior to the soldering of the contacts 48, the terminals 52, the solder and the contacts 48 will cooperate to apply maintain this force on the frame member 44 and the initiator chip 46.

Figure 8:
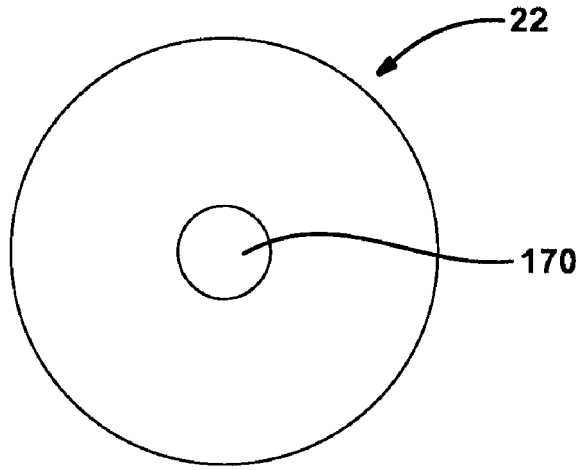
FIG. 8 is a top plan view of a portion of the header assembly illustrating the insulator barrel.

With reference to FIGS. 2 and 8, the insulator barrel 22 can be formed of a suitable electrically insulating material, such as polyamide. The insulator barrel 22 can cover the frame member 44 and the contacts 48 to electrically isolate these elements from the input sleeve 24. Additionally, the insulator barrel 22 can define a barrel aperture 170 through which the flyer 128 (FIG. 6) may be expelled when the initiator chip 46 is activated. In this regard, it will be appreciated that the barrel aperture 170, the flyer 128 (FIG. 6) and the bridge 122 (FIG. 6) are disposed in-line with one another.

It will be appreciated that the thicknesses of the insulator barrel 22, the contacts 48 and the solder that couples the contacts 48 to the terminals 52 and the electric interfaces is selected to space the bridge 122 (FIG. 6) apart from the input charge 26 by a predetermined spacing, such as about 0.004 inch to about 0.008 inch. It will be also appreciated that it can be important in some situations that the contacts 48 be relatively flat so as not to affect the spacing between the bridge 122 (FIG. 6) and the input charge 26.

The input sleeve 24 can be configured to support the input charge 26 and direct energy from the input charge 26 in a desired direction. In the particular example provided, the input sleeve 24 is formed of a suitable steel and defines a cavity 180 that can be located in-line with the bridge 122 (FIG. 6). The input charge 26 can be formed of a suitable energetic material, such as RSI-007, which is available from Reynolds Systems, Inc. of Middletown, Calif. The input charge 26 can be received in the cavity 180 in the input sleeve 24 and compacted to a desired density. It will be appreciated that in some applications, the input charge 26 may fill the entire volume of the cavity 180. It will also be appreciated that in some applications the input sleeve 24 may be deleted.

The barrier 28 can be employed to separate the input charge 26 from the output charge 30. In the particular example provided, the barrier 28 includes a first barrier member 200, a second barrier member 202 and a resilient member 204. The first barrier member 200, which can be abutted against the input sleeve 24, can be a formed of a reactive material, which may be a metal, such as titanium, or another suitably reactive material that is inert under normal circumstances. The second barrier member 202, which can be abutted against the first barrier member 200, can be formed of an oxidizable material, such as polytetrafluoroethylene. The resilient member 204 can be an annular silicone rubber element and can be disposed between the second barrier member 202 and the output charge 30. The barrier 28 can be tailored to a desired application to permit a desired amount of energy to be transmitted to the output charge 30 in a desired amount of time. In the particular example provided, the barrier 28 is employed to somewhat attenuate the energy that is released by the input charge 26, as well as to employ a portion of the energy that is released from the input charge 26 to initiate a reaction between the first and second barrier members 200 and 202 that generates additional heat.

The output charge 30 can be formed of a suitable energetic material, such as a secondary explosive and can be abutted against a side of the barrier 28 opposite the input sleeve 24. In the particular example provided, the output charge 30 is abutted against a side of the resilient member 204 opposite the second barrier member 202.

The cover 32 can be formed of a suitable material, such as KOVAR®, and can include a cover body 220 and a rim 222. The cover body 220 can be a cup-like structure that can receive the portion of the initiator 10 outwardly of the abutting face 70. The rim 222 can extend radially outwardly from the cover body 220 and can matingly engage the abutting face 70. The rim 222 and the shoulder 64 (FIG. 4) can be welded in an appropriate manner (e.g., laser welded) to fixedly and sealingly couple the cover 32 to the header body 50. It will be appreciated that a preload force can be applied to the cover 32 to seat the cover 32 to the header body 50 and as such, various components of the initiator 10, such as the output charge 30, the barrier 28, the frame 44 and the initiator chip 46 can be maintained in a state of compression.

While specific examples have been described in the specification and illustrated in the drawings, it will be understood by those of ordinary skill in the art that various changes may be made and equivalents may be substituted for elements thereof without departing from the scope of the present disclosure as defined in the claims. Furthermore, the mixing and matching of features, elements and/or functions between various examples is expressly contemplated herein so that one of ordinary skill in the art would appreciate from this disclosure that features, elements and/or functions of one example may be incorporated into another example as appropriate, unless described otherwise, above. Moreover, many modifications may be made to adapt a particular situation or material to the teachings of the present disclosure without departing from the essential scope thereof. Therefore, it is intended that the present disclosure not be limited to the particular examples illustrated by the drawings and described in the specification as the best mode presently contemplated for carrying out this invention, but that the scope of the present disclosure will include any embodiments falling within the foregoing description and the appended claims.

What is claimed is:

1. An initiator assembly comprising:

a header body having a plurality of first terminal apertures formed there through;

a plurality of seal members, each seal member being received in an associated one of the first terminal apertures;

an insulating spacer received over the header body;

a frame member overlying the insulating spacer, the frame member defining an interior aperture;

an initiator received in the interior aperture and abutted against the insulating spacer on a side opposite the header body, the initiator comprising an exploding foil initiator and including a plurality of initiator contacts; and a plurality of terminals, each of the terminals being received through the insulating spacer and an associated one of the seals, each of the terminals being disposed outwardly of the interior aperture and electrically coupled to an associated one of the initiator contacts.

2. The initiator assembly of claim 1, wherein a terminal-to-initiator contact forms at least a portion of an electrical path that electrically couples one of the terminals with a corresponding one of the initiator contacts.

3. The initiator assembly of claim 2, wherein the terminal-to-initiator contact is disposed on a side of the initiator opposite the insulating spacer.

4. The initiator assembly of claim 2, wherein a solder at least partly forms the electrical path.

5. The initiator assembly of claim 4, wherein the solder is disposed on a side of the initiator opposite the insulating spacer.

6. The initiator assembly of claim 4, wherein a hole is formed in at least one component of the initiator assembly, the hole being configured to permit visual inspection of the solder in the electrical path.

7. The initiator assembly of claim 1, wherein an adhesive bonds at least one of the frame member and the initiator to the insulating spacer.

8. The initiator assembly of claim 1, wherein the header body comprises a shoulder that defines a face that is perpendicular to longitudinal axes of the terminals, wherein a cover is fitted over the header body, the cover having a rim that abuts the face and wherein the rim is welded to the shoulder to fixedly and sealingly couple the cover to the header body.

9. The initiator assembly of claim 8, wherein a compressive load is imparted to and maintained on the initiator and the frame member when the cover is fixedly coupled to the header body.

10. An initiator assembly comprising:

a header body having a plurality of first terminal apertures formed there through;

a plurality of seal members, each seal member being received in an associated one of the first terminal apertures;

an insulating spacer received over the header body;

a structure having an insulating body, a plurality of initiator contacts and a bridge, the insulating body overlying the insulating spacer, the initiator contacts and the bridge being coupled to the insulating body, the bridge being configured to form a plasma to initiate an event involving one or more of combustion, deflagration and detonation; and a plurality of terminals, each of the terminals being received through the insulating spacer, an associated one of the initiator contacts, and an associated one of the seals, each of the terminals being electrically coupled to an associated one of the initiator contacts.

11. The initiator assembly of claim 10, wherein the structure further comprises a substrate that is fixedly coupled to the insulating body, and wherein the initiator contacts and the bridge are fixedly coupled to the substrate.

12. The initiator assembly of claim 11, wherein the substrate is received in an interior aperture formed in the insulating body.

13. The initiator assembly of claim 11, wherein an adhesive bonds at least one of the insulating body and the substrate to the insulating spacer.

14. The initiator assembly of claim 10, wherein a terminal-to-initiator contact forms at least a portion of an electrical path that electrically couples one of the terminals with a corresponding one of the initiator contacts.

15. The initiator assembly of claim 14, wherein the terminal-to-initiator contact is disposed on a side of the initiator opposite the insulating spacer.

16. The initiator assembly of claim 14, wherein a solder at least partly forms the electrical path.

17. The initiator assembly of claim 16, wherein the solder is disposed on a side of the initiator opposite the insulating spacer.

18. The initiator assembly of claim 16, wherein a hole is formed in at least one component of the initiator assembly, the hole being configured to permit visual inspection of the solder in the electrical path.

19. An initiator assembly comprising:

a header body having a plurality of first terminal apertures formed there through;

a plurality of seal members, each seal member being received in an associated one of the first terminal apertures;

an insulating spacer received over the header body;

a structure having an insulating body, a plurality of initiator contacts and an exploding foil initiator, the insulating body overlying the insulating spacer, the initiator contacts and the exploding foil initiator being coupled to the insulating body; and a plurality of terminals, each of the terminals being received through the insulating spacer and an associated one of the seals, each of the terminals being electrically coupled to-an associated one of the initiator contacts;

wherein an adhesive bonds the structure to the insulating spacer;

wherein a terminal-to-initiator contact forms at least a portion of an electrical path that electrically couples one of the terminals with a corresponding one of the initiator contacts; and wherein a solder at least partly forms the electrical path.

* * * * *